US006675747B1

(12) United States Patent
Goidich et al.

(10) Patent No.: US 6,675,747 B1
(45) Date of Patent: Jan. 13, 2004

(54) SYSTEM FOR AND METHOD OF GENERATING STEAM FOR USE IN OIL RECOVERY PROCESSES

(75) Inventors: Stephen J. Goidich, Palmerton, PA (US); Gopal D. Gupta, East Hanover, NJ (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 0 days.

(21) Appl. No.: 10/225,241

(22) Filed: Aug. 22, 2002

(51) Int. Cl.[7] ..... F22B 33/12
(52) U.S. Cl. ..... 122/406.4; 122/1 B
(58) Field of Search ..... 122/1 B, 406.4, 122/6 A, 451 S, 1 C; 110/342, 347

(56) References Cited

U.S. PATENT DOCUMENTS 4,430,962 A * 2/1984 Miszak ..... 122/406.4
4,869,210 A * 9/1989 Wittchow ..... 122/451 S
5,560,322 A * 10/1996 Fitzgerald ..... 122/64
5,735,236 A * 4/1998 Kastner et al. ..... 122/6 A
5,950,574 A * 9/1999 Matsuda et al. ..... 122/460

* cited by examiner

*Primary Examiner*—Gregory Wilson
(74) *Attorney, Agent, or Firm*—Fitzpatrick, Cella, Harper & Scinto

(57) ABSTRACT

A once-through boiler system for use in conjunction with a combustion chamber includes a water inlet through which water having a high total dissolved solids content is supplied to the system, at least one tubular preheating surface for preheating the water as the water flows through the preheating surface, and at least one tubular evaporation surface for further heating the water flowing therein to produce a steam/water mixture. The preheating surface is disposed downstream from the inlet and encloses at least part of the combustion chamber, and the evaporation surface is disposed within the combustion chamber, downstream from the preheating surface. Also, a method of producing a steam/water mixture from water having a high total dissolved solids content by using a once-through boiler system provided in conjunction with a combustion chamber includes steps of supplying water having a high total dissolved solids content to the boiler system, preheating the water by directing the water through at least one tubular preheating surface that encloses at least part of the combustion chamber, and further heating the water to produce a steam/water mixture by directing the preheated water through at least one tubular evaporation surface disposed within the combustion chamber.

29 Claims, 2 Drawing Sheets

SYSTEM FOR AND METHOD OF GENERATING STEAM FOR USE IN OIL RECOVERY PROCESSES

BACKGROUND OF THE INVENTION

1. Field of the Invention

Our invention relates generally to a system for and a method of generating steam for use in enhanced oil recovery processes. More particularly, our invention relates to a system for and a method of producing a steam/water mixture from feedwater having a high total dissolved solids content.

2. Description of the Related Art

Steam injection is used in the oil industry to promote the flow of viscous, heavy oils or liquid hydrocarbons from tar sands. Because the feedwater available to boilers at oil fields is normally of poor quality, having a very high proportion of total dissolved solids (TDS), boilers for such applications usually employ a single-tube flow path throughout the unit. A very high proportion of total dissolved solids (TDS) in this application is intended to mean an amount above about 2,000 ppm, especially, above about 5,000 ppm. The quality of the produced steam, i.e., the ratio of the mass flow rate of the gas phase to the total mass flow rate, is usually limited to not greater than about 80% steam. By maintaining at least this level of residual water throughout the flow path, and by employing a high fluid velocity along the flow path, salts and other dissolved solids are kept in solution to prevent their deposition inside the boiler tubes.

Typical boilers utilized for enhanced oil recovery applications are small-scale, once-through boilers fired with oil or gas. Usually, a single large diameter tube or a few parallel tubes are configured in a helical or serpentine arrangement to form the furnace or combustion chamber enclosure. These tubes then extend into a heat recovery area of an exhaust gas passage to further cool the flue gas and to complete the generation of 80% quality steam.

A natural circulation boiler with a steam drum has also been used for enhanced oil recovery applications. Saturated steam leaving the steam drum is mixed with drum blowdown water to provide 80% quality steam. As steam is generated, the TDS concentration of the water in the boiler increases. With high-TDS feedwater, the tendency for foam formation may become severe, which can cause drum level control problems as well as increased potential for tube failure due to dynamic instability and/or dryout. Therefore, anti-foaming chemicals must be added to the boiler water to minimize foam formation.

For large boiler applications, i.e., when production of more than about 100 tons per hour of the steam/water mixture is required, it is mechanically difficult to design the furnace enclosure to be a once-through configuration. A drum-type boiler simplifies the configuration, but does not eliminate the concerns noted above with respect to high-TDS feedwater.

SUMMARY OF THE INVENTION

Our invention provides an improved steam generation system and method suited for use in connection with enhanced oil recovery processes. Our invention is particularly suited for producing a steam/water mixture from water having a high total dissolved solids content, i.e., an amount above about 2,000 ppm, especially, above about 5,000 ppm.

In one aspect, our invention relates to a once-through boiler system for use in conjunction with a combustion chamber. The system includes a water inlet through which water having a high total dissolved solids content is supplied, at least one tubular preheating surface for preheating the water as the water flows through the preheating surface, and at least one tubular evaporation surface for further heating the water flowing therein to produce a steam/water mixture. The preheating surface is disposed downstream from the inlet and encloses at least part of the combustion chamber. Meanwhile, the evaporation surface is disposed within the combustion chamber, downstream from the preheating surface.

Such a boiler system thus differs from conventional systems in that the combustion chamber is enclosed at least in part by one or more preheating surfaces, instead of evaporation surfaces. A benefit of using water to cool the combustion chamber enclosure—as opposed to a steam/water mixture—is that relatively small diameter tubes can be used to form the enclosure, thereby providing more efficient cooling of the enclosure while reducing the likelihood of deposit buildups inside the tubes. In a preferred embodiment, for example, the combustion chamber is enclosed at least in part by a plurality of tubular preheating surfaces, and each of the preheating surfaces comprises a tube panel having a plurality of individual tubes. Preferably, each of the individual tubes has an outer diameter of less than about 50 mm, more preferably less than about 40 mm.

The plurality of preheating surfaces preferably is arranged in a multiple-pass configuration. That is, the preheating surfaces are arranged so that the water makes multiple passes over the combustion chamber enclosure before moving on to the next stage. The multiple-pass configuration permits a relatively high flow velocity to be maintained through the preheating tubes, which further reduces the likelihood of deposit buildups inside the tubes. The multiple-pass configuration also limits the temperature pickup per pass so that temperature unbalances are minimized. Complete mixing between passes further minimizes any unbalances. Preferably, the mass flux of water flowing through the preheating tubes is at least about 1000 $kg/m^2s$, more preferably at least about 1300 $kg/m^2s$.

Meanwhile, the evaporation surface within the combustion chamber preferably comprises a wingwall panel including a plurality of individual tubes. Preferably, each of the individual tubes has an outer diameter of at least about 70 mm, more preferably at least about 90 mm. Preferably, the mass flux of water flowing through the wingwall panel tubes is at least about 1000 $kg/m^2s$, more preferably at least about 1300 $kg/m^2s$.

Preferably, the system further comprises at least one additional tubular preheating surface that encloses at least part of a heat recovery area of an exhaust passage through which exhaust gases are discharged from the combustion chamber. This preheating surface preferably is disposed downstream from the one or more preheating surfaces that enclose at least part of the combustion chamber, but upstream from the one or more evaporation surfaces within the combustion chamber. Preferably, at least part of the heat recovery area is enclosed by a plurality of tubular preheating surfaces that is arranged in a multiple-pass configuration.

Optionally, the system may further comprise at least one more additional tubular preheating surface disposed within the heat recovery area. This preheating surface may comprise, for example, a stringer-type support tube, an economizer, or the like.

Preferably, the system also comprises at least one additional tubular evaporation surface disposed within the heat recovery area, downstream from the evaporation surface within the combustion chamber. In a particularly preferred embodiment, the evaporation surface within the combustion chamber includes an outlet header that is divided into one or more outlet sections, and the evaporation surface within the heat recovery area comprises a corresponding number of individual tubes, each tube being in flow communication with a different one of the outlet sections. Preferably, these individual tubes do not interconnect with each other, thereby reducing the risk of uneven flow distribution through the individual tubes of this evaporation surface.

In another aspect, our invention relates to a method of producing a steam/water mixture from water having a high total dissolved solids content by using a once-through boiler system provided in conjunction with a combustion chamber. The method includes the steps of (i) supplying water having a high total dissolved solids content to the boiler system, (ii) preheating the water by directing the water through at least one tubular preheating surface that encloses at least part of the combustion chamber, and (iii) further heating the water to produce a steam/water mixture by directing the preheated water through at least one tubular evaporation surface disposed within the combustion chamber.

Our invention thus enables the design of a large-scale, once-through boiler that is capable of reliably meeting the requirements for enhanced oil recovery in an efficient and economical way. The concept, however, is also applicable to small size boilers. The invention can be applied to suspension-fired or circulating fluidized bed boilers utilizing a variety of low cost fuels and feedstocks. Compared to conventional boilers having a natural circulation drum-type design, our invention eliminates the need for several pressure components, making our system much more cost effective. Additionally, a boiler system constructed in accordance with our invention is simple, practical, and easy to repair and maintain.

BRIEF DESCRIPTION OF THE DRAWINGS

The above brief description, as well as further features and advantages of our invention, will be more fully appreciated by reference to the following detailed description of a presently preferred, but merely illustrative, embodiment of the invention, taken in conjunction with the accompanying drawings, wherein.

Except as otherwise disclosed herein, the various components shown in outline or block form in the figures are individually well known and their internal construction and operation are not critical either to the making or using of this invention or to a description of the best mode of the invention.

DESCRIPTION OF THE PREFERRED EMBODIMENT

Figure 1:
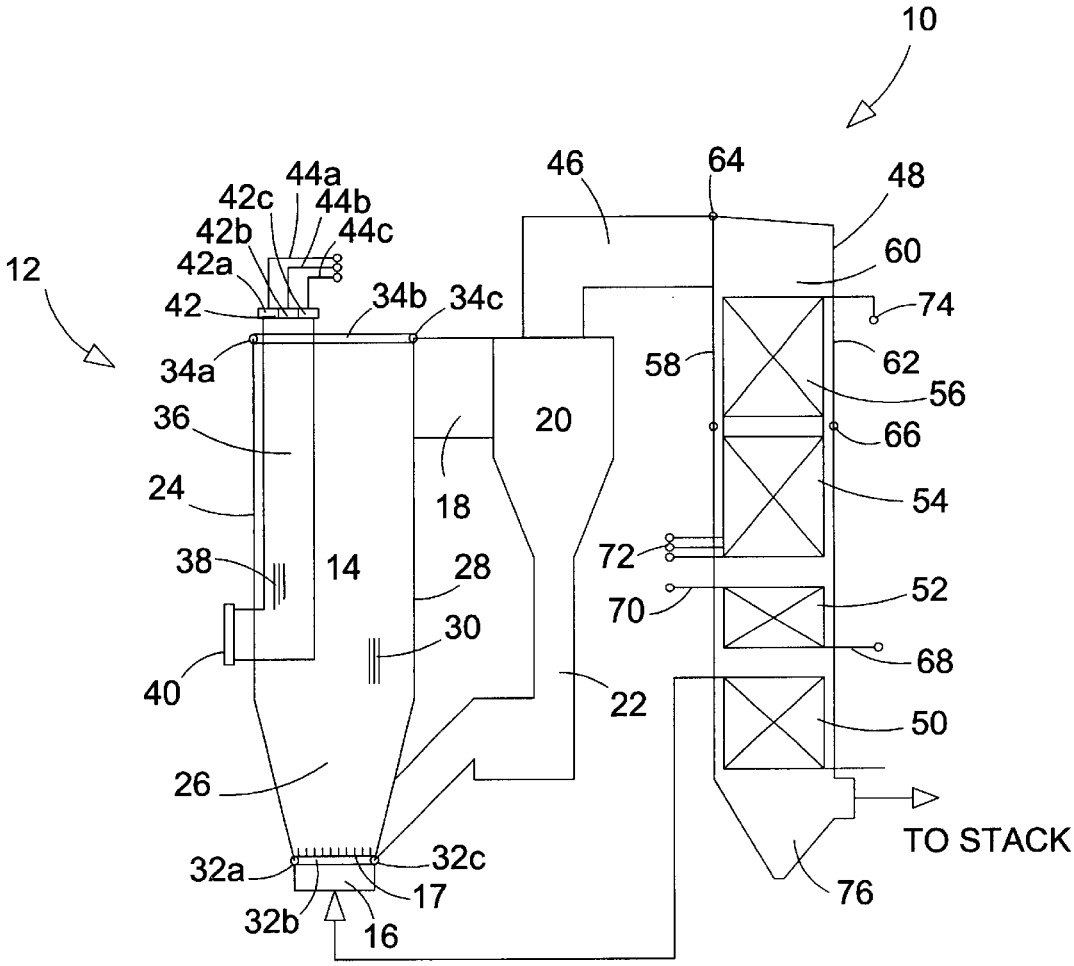
FIG. 1 shows a schematic layout of a boiler plant according to a preferred embodiment of our invention.

FIG. 1 shows a schematic layout of a boiler plant 10 according to a preferred embodiment of our invention. Reference numeral 12 generally denotes a circulating fluidized bed (CFB) combustor 12, in which fuel, bed material, and possibly also a sorbent material are fluidized in a furnace (i.e., combustion chamber) 14 using fluidizing air introduced into the furnace 14 by conventional combustion air introduction means, which typically include a windbox 16 and fluidizing air nozzles 17. Combustion air usually is introduced into the furnace 14 at different levels, but for clarity, FIG. 1 shows the air introduction means only at the bottom of the furnace 14.

Exhaust gases produced in the furnace 14 and particles entrained therein are discharged through a channel 18 extending from the upper part of the furnace 14 to a solids separator 20, which is preferably a cyclone-type separator. In the solids separator 20, most of the entrained particles are separated from the exhaust gases and returned to the furnace 14 via a return duct 22.

The furnace 14 is enclosed at least in part by one or more tubular preheating surfaces. In the preferred embodiment shown in FIG. 1, the furnace 14 is enclosed by a front wall 24, two side walls 26 (of which only one is seen in FIG. 1), and a rear wall 28, which are formed of conventional tube panels. As feedwater flows through the tube panels that form the furnace enclosure, heat from within the furnace preheats the feedwater. The tube panels preferably are constructed of vertical tubes 30 welded together by fins and arranged in parallel between inlet headers 32*a*, 32*b*, and 32*c* of the tube panels of the front wall 24, side walls 26, and rear wall 28, respectively, and corresponding outlet headers 34*a*, 34*b*, and 34*c*.

The tube panels of the front wall 24, the side walls 26, and the rear wall 28 preferably are connected in a multiple-pass configuration. That is, the tube panels are connected in series so that feedwater introduced into the inlet header 32*a* of the tube panel of the front wall 24 flows through that tube panel and exits from outlet header 34*a*. The feedwater then flows from outlet header 34*a* into inlet headers 32*b* of the tube panels of the two side walls 26. After flowing through the tube panels of the two side walls 26, the feedwater exits from outlet headers 34*b* and flows into inlet header 32*c* of the tube panel of the rear wall 28. After flowing through the tube panel of the rear wall 28, the heated (but not evaporating) feedwater exits from the outlet header 34*c* and is directed to the next heat transfer stage, described below.

Because only water—as opposed to a steam/water mixture—flows through the tubes 30 that enclose the furnace 14, relatively small tubes having preferably less than about a 50 mm outer diameter, more preferably less than about a 40 mm outer diameter, may be used to form the furnace enclosure. Due to the multiple-pass configuration, such tubes are capable of achieving the required mass flow for cooling the furnace walls while also preventing the deposition of dissolved solids inside the tubes 30. Preferably, the mass flux in the preheating tubes 30 is at least about 1000 $kg/m^2s$, most preferably at least about 1300 $kg/m^2s$. Furnace width and depth preferably are selected so that an equal number of tubes are utilized for each pass.

A first set of tubular evaporation surfaces is provided within the furnace enclosure. In the preferred embodiment shown in FIG. 1, these internal evaporation surfaces are formed as one or more wingwall panels 36, i.e., tube panels suspended from the furnace roof, having outlet headers 42 provided above the furnace roof and inlet headers 40 provided outside the front wall 24 of the furnace 14. Each wingwall panel 36 comprises one or more evaporation tubes 38, which may have a larger diameter than the preheating tubes 30 that form the furnace enclosure. Preferably, the evaporation tubes 38 have an outer diameter of at least about 70 mm, more preferably at least about 90 mm. The number and size of the evaporation tubes 38 are selected to provide a sufficient flow velocity. Preferably, the mass flux in the evaporation tubes 38 is at least about 1000 $kg/m^2s$, most preferably at least about 1300 kg/m$^2$s. Due to the high flow velocity and relatively large tube size, the solids are kept in the water solution and deposition inside the tubes 38 is substantially prevented.

Water is distributed among the evaporation tubes 38 of each wingwall panel 36 by an inlet header 40. Meanwhile, an outlet header 42 of each wingwall panel 36 is divided into sections 42*a,* 42*b,* and 42*c,* which are connected to outlet pipes 44*a,* 44*b,* and 44*c*, respectively. Each evaporation tube 38 is in flow communication with only one outlet section 42*a,* 42*b,* or 42*c,* and, consequently, with only one outlet pipe 44*a,* 44*b,* or 44*c*. This reduces the chance that water and steam will be distributed unevenly among the different outlet pipes 44*a,* 44*b,* and 44*c*. Although the outlet header 42 shown in FIG. 1 is divided into three outlet sections, the number of the outlet sections may also be other than three. When using narrow wingwall panels, for instance, it may even be desirable to have an unsectioned outlet header connected to a single outlet pipe.

As an alternative to wingwall panels, the internal evaporation surfaces could be constructed as full or partial division walls, evaporation columns, or other known evaporation tube structures within the furnace 14.

The exhaust gases are directed away from the solids separator 20 through an exhaust passage 46 that includes a heat recovery area (HRA) 48 in which an air heater 50, an economizer 52, and a second set of tubular evaporation surfaces comprising first and second tube bundles 54 and 56 are provided. The first and second tube bundles 54 and 56 are preferably connected in the steam/water mixture flow path in series and downstream from the wingwall panels 36. They are preferably arranged as serpentine coil-like structures within the HRA 48. Cooled exhaust gases are directed from the downstream end 76 of the HRA 48 via conventional dust and emission reduction means (not shown) to a stack (not shown), from where the exhaust gases are released to the environment.

Preferably, at least part of the HRA 48 is enclosed by one or more tubular preheating surfaces. In the preferred embodiment shown in FIG. 1, the HRA 48 is enclosed by a front wall 58, side walls 60 (of which only one is seen in FIG. 1), and rear wall 62, which are formed of tube panels comprising vertical tubes connected in parallel between inlet and outlet headers 64 and 66. The tube panels that form the walls 58, 60, and 62 of the HRA enclosure preferably are connected in series, i.e., in a multiple-pass configuration, similar to the tube panels that form the walls 24, 26, and 28 of the furnace enclosure.

In the preferred embodiment shown in FIG. 1, feedwater enters the system through the economizer inlet 68, after which it passes through the economizer 52 and out of the economizer outlet 70. The outlet 70, in turn, is in flow communication with the inlet header 32*a* of the tube panel that forms the front wall 24 of the furnace 14, i.e., the first of the multiple-pass preheating surfaces that form the furnace enclosure. After flowing through each of the furnace preheating surfaces, the heated (but not evaporating) water is directed, from the outlet header 34*c* to the inlet 64 of the multiple-pass preheating surfaces that form the HRA enclosure. Locating the furnace preheating surfaces upstream from those of the HRA preheating surfaces allows for relatively cold water to be introduced into the tubes 30 of the furnace 14, thereby promoting efficient cooling of the furnace 14.

After flowing through each of the HRA preheating surfaces, the further heated (but still not evaporating) water is directed from the outlet header 66 to the inlet headers 40 of the wingwall panels 36. Optionally, one or more stringer-type support tubes (not shown) may be provided between the outlet header 66 and the inlet headers 40 for providing additional preheating, and also for supporting the tube bundles 54 and 56, for example. The water reaches the inlets 40 of the wingwall panels 36 in a heated but non-evaporating state. This allows the water flow to be evenly split among the parallel evaporation tubes 38.

The water begins to evaporate once inside the wingwall panels 36, thereby generating a mixture of water and steam within the wingwall panels 36. To avoid an uneven distribution of the steam/water mixture, the outlet header 42 of each wingwall panel 36 is divided into sections 42*a,* 42*b,* and 42*c,* each of which is connected to a respective outlet pipe 44*a,* 44*b,* or 44*c*.

Each of the outlet pipes 44*a,* 44*b,* and 44*c,* in turn, is in flow communication with an inlet connection 72 of an evaporation tube of the first tube bundle 54. Preferably, each of the outlet pipes 44*a,* 44*b,* and 44*c* is connected to a different inlet connection 72, but in some applications it may be advantageous to have multiple outlet pipes connected to a common inlet connection. Each evaporation tube of the first tube bundle 54 is preferably connected on a one-to-one basis to an evaporation tube of the second tube bundle 56. In some applications, however, it may be advantageous to have fewer evaporation tubes in the second bundle 56 than in the first bundle 54. For example, multiple evaporation tubes of the first bundle 54 could be connected to a single evaporation tube of the second bundle 56. In order to avoid splitting of the steam water mixture flow, no one tube of the first bundle 54 should be connected to multiple tubes of the second bundle 56. It also is possible to use just one tube bundle, or more than two tube bundles, in which case, corresponding evaporation tubes of each tube bundle would be connected similarly, preferably on a one-to-one basis.

In the second tube bundle 56, the steam generation is completed so that steam of about 80% quality is produced. At the downstream end of the second tube bundle 56, all of the evaporation tubes of that bundle are connected to a common outlet header 74. The steam leaving the system at the outlet header 74 may be utilized for enhanced oil recovery. If desired, the system may comprise several outlet headers 74 for distributing the steam to multiple locations.

In the preferred embodiment shown in FIG. 1, the multiple water flow paths between the inlet headers 40 of the wingwalls 36 and the outlet header 74 of the second evaporation tube bundle 56 do not split into multiple separate paths. Thus, the steam/water mixture flows from the evaporation surfaces within the furnace 14 through the evaporation surfaces within the HRA in a plurality of non-splitting, continuous streams. If, for example, the first set of evaporation surfaces comprises eight wingwall panels, each having three outlet sections, then the first and second tube bundles 54 and 56 would preferably comprise a serpentine coil of twenty-four evaporation tubes running from the inlet connections 72 to the outlet header 74.

The preferred embodiment shown in FIG. 1 utilizes a conventional CFB boiler with uncooled plate-type cyclones discharging into a conventional HRA. However, the CFB boiler may also take on other configurations, such as, for example, a cooled plane-walled cyclone, where the walls of the cyclone are preferably also used as further preheating surfaces. The exhaust passage 46 may also be directed over the top of the furnace 14, and the HRA enclosure may be integrated with the furnace construction. The boiler may also be of a type other than a CFB boiler, e.g., a suspension-fired boiler.

In an example in which petroleum coke is used as a fuel to generate 450 tons per hour of 80% quality steam at a pressure of 150 bar, the approximate exhaust gas temperatures in selected locations of the exhaust passage 46 are as follows: 884° C. at the inlet of the HRA; 480° C. at the outlet of the first evaporation tube bundle 56; 400° C. at the outlet of the second evaporation tube bundle 54; 230° C. at the outlet of the economizer 52; and 150° C. at the outlet of the air heater 50.

Figure 2:
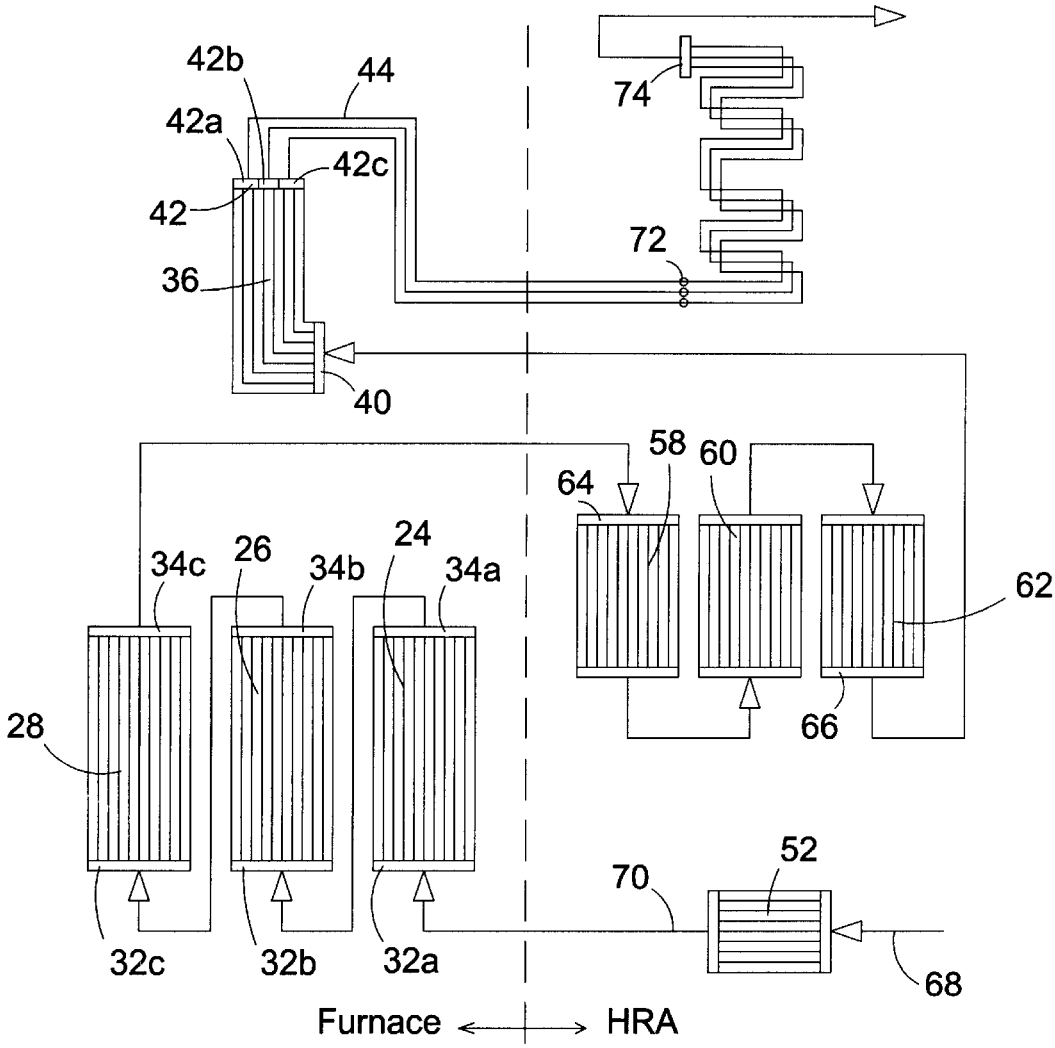
FIG. 2 schematically illustrates a preferred steam/water flow path through the boiler plant shown in FIG. 1.

FIG. 2 schematically illustrates a preferred steam/water flow path through the boiler plant 10 shown in FIG. 1. The same reference numerals are used in both FIGS. 1 and 2 to identify the same parts of the system. A vertical dashed line separates the parts of the steam/water flow path located in the HRA and the furnace.

Cold feedwater first enters the system through the economizer inlet 68. The economizer 52, which is disposed within the HRA, may either cool the flue gases to the stack temperature or discharge the flue gases into an air heater (designated by reference numeral 50 in FIG. 1) for further cooling. The feedwater exits the economizer 52 through economizer outlet 70.

The feedwater then flows to the preheating surfaces that form the furnace enclosure for further preheating. There, the still relatively cold water is heated as it flows through the series of tube panels that form the different walls 24, 26, and 28 of the furnace. According to a preferred embodiment of the present invention, the inlet header 32*a* directs the water flow into parallel tubes on the front wall 24 of the furnace. The water is heated as it flows upward through these tubes, and, upon reaching the outlet header 34*a*, preferably is combined back info two streams that are directed to the inlet headers 32*b* on the lower edge of the two side walls 26 (shown as one in FIG. 2) of the furnace. There, the water is further split into multiple streams which are directed upward through the side wall tubes, where the water is further heated. Upon reaching the outlet headers 34*b*, the multiple streams preferably are combined back into a single stream that is directed to the inlet header 32*c* at the lower edge of the rear wall 28 of the furnace. Once again, the water is split into multiple streams which are directed upward through the rear wall tubes for further heating.

FIG. 2 shows a preferred multiple-pass flow path, but the order of the passes and the water flow direction may be different than what is shown in FIG. 2. The multiple-pass configuration provides for efficient tube cooling and high mass flow rates, which contributes to a reduction in the deposition of dissolved solids on the inside of the tubes. The multiple-pass configuration also limits the temperature pickup per pass so that temperature unbalances are minimized. Complete mixing between passes further minimizes any unbalances.

After exiting through the outlet header 34*c* of the rear wall 28 of the furnace, the subcooled feedwater is directed to the preheating surfaces that form the HRA enclosure for further preheating. The flow path of the water through the various tube panels of the HRA enclosure is similar to the multiple-pass flow path through the furnace tube panels, except that in the preferred embodiment shown, the water flows downward through the tube panels that form the front and rear walls 58 and 62 of the HRA enclosure. Those skilled in the art will appreciate, however, that the direction of water flow and the order of the passes can be varied.

The subcooled feedwater is directed from the last outlet header 66 of the HRA tube panels to the evaporation surfaces within the furnace, which, in this preferred embodiment, comprise wingwall panels 36 or other suitable evaporation structures. Optionally, one or more stringer-type support tubes (not shown in FIG. 2) may be interposed along the flow path between the outlet header 66 and the wingwall panels 36.

Each wingwall panel 36 preferably comprises a plurality of parallel evaporation tubes connected between inlet and outlet headers 40 and 42, respectively. It is within the wingwall panels 36 that the feedwater reaches the saturation temperature and steam formation begins. One or more pipes 44 are connected to each wingwall outlet header 42 to direct the steam/water mixture again back to the HRA. If more than one outlet pipe is utilized per wingwall panel, the outlet header is partitioned into separate outlet sections 42*a*, 42*b*, and 42*c* equal to the number of outlet pipes 44. Each of the outlet header sections 42*a*, 42*b*, and 42*c* is connected to a different one of the outlet pipes 44 so that the two-place steam/water mixture generated within a particular evaporation tube of the wingwall panel 36 is not distributed to multiple outlet pipes.

The steam/water mixture entering each pipe 44 continues without splitting to one or more sequential evaporative, serpentine-like tube bundles within the HRA, where the steam/water mixture is further heated until a mixture of required steam quality, e.g. 80%, is achieved. The number of tubes extending from each wingwall panel 36 is selected to provide the necessary mass flow rate within the near horizontal HRA tube bundle(s). Individual tubes within the HRA tube bundle(s) preferably are inclined for drainage purposes.

The system is configured to ensure that a two-phase steam/water mixture does not enter the wingwall panels 36. Further, the individual tubes within the wingwall panels are grouped so that flow entering a particular outlet header section 42*a*, 42*b*, or 42*c* feeds only one outlet pipe 44 and tube bundle evaporation tube within the HRA. Thus, the number of outlet pipes 44 from the evaporative wingwall panels 36 is equal to the number of tubes that form the tube bundles 54 and 56 in the HRA. That way, the steam/water mixture does not have to be apportioned in its two-phase state among multiple tubes.

Preferably, all tube panels and tube bundles are drainable. Therefore, we prefer that the outlet headers 42*a*, 42*b*, and 42*c* of each wingwall panel 36 be elevated with respect to the inlet connections 72 to the HRA tube bundles. At the low point in the piping between the outlet headers 42*a*, 42*b*, and 42*c*, and the inlet connections, drains are provided in the outlet pipes 44.

While the invention has been herein described by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

We claim:

1. A once-through boiler system for use in conjunction with a combustion chamber, the system comprising:

a water inlet through which water having a high total dissolved solids content is supplied to the system;

at least one tubular preheating surface for preheating the water as the water flows through the preheating surface, the preheating surface being disposed downstream from the inlet and enclosing at least part of the combustion chamber; and at least one tubular evaporation surface disposed within the combustion chamber, downstream from the preheating surface, for further heating the water flowing therein to produce a steam/water mixture.

2. The system of claim 1, wherein at least part of the combustion chamber is enclosed by a plurality of tubular preheating surfaces that is arranged in a multiple-pass configuration.

3. The system of claim 2, wherein each of the preheating surfaces comprises a tube panel, and each tube panel comprises a plurality of individual tubes.

4. The system of claim 3, wherein each of the individual tubes has an outer diameter of less than about 50 mm.

5. The system of claim 3, wherein each of the individual tubes has an outer diameter of less than about 40 mm.

6. The system of claim 1, wherein the evaporation surface within the combustion chamber comprises a wingwall panel including a plurality of individual tubes.

7. The system of claim 6, wherein each of the individual tubes has an outer diameter of at least about 70 mm.

8. The system of claim 6, wherein each of the individual tubes has an outer diameter of at least about 90 mm.

9. The system of claim 1, further comprising at least one additional tubular preheating surface that encloses at least part of a heat recovery area of an exhaust passage through which exhaust gases are discharged from the combustion chamber.

10. The system of claim 9, wherein the preheating surface that encloses at least part of the heat recovery area is disposed downstream from the preheating surface that encloses at least part of the combustion chamber, but upstream from the evaporation surface within the combustion chamber.

11. The system of claim 10, further comprising at least one more additional tubular preheating surface disposed within the heat recovery area, downstream from the preheating surface that encloses the heat recovery area, but upstream from the evaporation surface within the combustion chamber.

12. The system of claim 9, wherein at least part of the heat recovery area is enclosed by a plurality of tubular preheating surfaces that is arranged in a multiple-pass configuration.

13. The system of claim 1, further comprising at least one additional tubular evaporation surface disposed within a heat recovery area of an exhaust passage through which exhaust gases are discharged from the combustion chamber.

14. The system of claim 13, wherein the evaporation surface within the heat recovery area is connected in the steam/water mixture flow path downstream from the evaporation surface within the combustion chamber.

15. The system of claim 14, wherein the evaporation surface within the combustion chamber includes an outlet header that is divided into one or more outlet sections, the evaporation surface within the heat recovery area comprises a plurality of individual tubes, and each outlet section is in flow communication with only one of the plurality of individual tubes.

16. The system of claim 15, wherein the number of individual tubes equals the number of outlet sections, and each of the outlet sections is in flow communication with a different one of the individual tubes.

17. The system of claim 15, wherein the individual tubes within the heat recovery area do not split into multiple tubes at a downstream point.

18. The system of claim 17, wherein the individual tubes of the evaporation surface within the heat recovery area do not interconnect with each other.

19. A method of producing a steam/water mixture from water having a high total dissolved solids content by using a once-through boiler system provided in conjunction with a combustion chamber, the method comprising the steps of:

supplying water having a high total dissolved solids content to the boiler system;

preheating the water by directing the water through at least one tubular preheating surface that encloses at least part of the combustion chamber; and further heating the water to produce a steam/water mixture by directing the preheated water through at least one tubular evaporation surface disposed within the combustion chamber.

20. The method of claim 19, wherein the preheating step involves directing the water through a plurality of tubular preheating surfaces that is arranged in a multiple-pass configuration.

21. The method of claim 19, wherein the mass flux of water flowing through the preheating surface is at least about 1000 kg/m2s.

22. The method of claim 19, wherein the mass flux of water flowing through the preheating surface is at least about 1300 kg/m2s.

23. The method of claim 19, wherein the mass flux of the steam/water mixture flowing through the evaporation surface is at least about 1000 kg/m2s.

24. The method of claim 19, wherein the mass flux of the steam/water mixture flowing through the evaporation surface is at least about 1300 kg/m2s.

25. The method of claim 19, wherein the preheating step further involves directing the water through at least one tubular preheating surface that encloses at least part of a heat recovery area of an exhaust passage through which exhaust gases are discharged from the combustion chamber.

26. The method of claim 25, wherein the preheating step further involves directing the water through at least one tubular preheating surface disposed within the heat recovery area.

27. The method of claim 19, wherein the preheating step further involves directing the water through a plurality of tubular preheating surfaces that (i) encloses at least part of a heat recovery area of an exhaust passage through which exhaust gases are discharged from the combustion chamber and (ii) is arranged in a multiple-pass configuration.

28. The method of claim 19, wherein the further heating step further involves directing the steam/water mixture produced by the evaporation surface within the combustion chamber through at least one additional tubular evaporation surface disposed within a heat recovery area of an exhaust passage through which exhaust gases are discharged from the combustion chamber.

29. The method of claim 28, wherein the steam/water mixture is directed from the evaporation surface within the combustion chamber through the evaporation surface within the heat recovery area in a plurality of continuous streams, with each of the continuous streams not splitting into multiple streams at a downstream point.

* * * * *